US007080797B2

(12) United States Patent
Doering et al.

(10) Patent No.: US 7,080,797 B2
(45) Date of Patent: Jul. 25, 2006

(54) PUMP IMPELLER AND CHOPPER PLATE FOR A CENTRIFUGAL PUMP

(75) Inventors: Brandon R. Doering, West Jordan, UT (US); James C. Harmon, Salt Lake City, UT (US); James G. Shaw, Draper, UT (US)

(73) Assignee: EnviroTech Pumpsystems, Inc., Salt Lake City, UT (US)

( * ) Notice: Subject to any disclaimer, the term of this patent is extended or adjusted under 35 U.S.C. 154(b) by 175 days.

(21) Appl. No.: 10/877,760

(22) Filed: Jun. 25, 2004
(Under 37 CFR 1.47)

(65) Prior Publication Data

US 2005/0045757 A1 Mar. 3, 2005

Related U.S. Application Data

(60) Provisional application No. 60/482,977, filed on Jun. 27, 2003.

(51) Int. Cl.
*B02C 23/36* (2006.01)
*B02C 23/02* (2006.01)
*F01D 5/12* (2006.01)

(52) U.S. Cl. ..... 241/46.08; 241/185.6; 415/121.1

(58) Field of Classification Search ..... 241/46.08, 241/46.06, 185.6; 415/121.1, 71; 416/176, 416/177, 179, 183, 185
See application file for complete search history.

(56) References Cited

U.S. PATENT DOCUMENTS

| | | | | |
|---|---|---|---|---|
| 2,245,035 | A * | 6/1941 | Hartman | 241/38 |
| 3,155,046 | A | 11/1964 | Vaughan | |
| 3,692,422 | A * | 9/1972 | Girardier | 415/121.1 |
| 3,774,323 | A | 11/1973 | Vaughn | |
| 3,973,866 | A | 8/1976 | Vaughan | |
| 4,454,993 | A | 6/1984 | Shibata et al. | |
| 4,767,277 | A * | 8/1988 | Buse | 416/241 A |
| 4,840,384 | A | 6/1989 | Dorsch | |
| 4,842,479 | A | 6/1989 | Dorsch | |
| 5,076,757 | A | 12/1991 | Dorsch | |
| 5,256,032 | A | 10/1993 | Dorsch | |
| 5,456,580 | A | 10/1995 | Dorsch | |
| 5,460,482 | A | 10/1995 | Dorsch | |
| 5,460,483 | A | 10/1995 | Dorsch | |
| 6,190,121 | B1 | 2/2001 | Hayward et al. | |
| 6,224,331 | B1 | 5/2001 | Hayward et al. | |

* cited by examiner

*Primary Examiner*—Faye Francis
(74) *Attorney, Agent, or Firm*—Morriss O'Bryant Compagni, P.C.

(57) ABSTRACT

A centrifugal pump of the chopper type is disclosed which is structured with a chopper plate and impeller that are configured with an open eye or "hubless" arrangement such that processing of solids through the pump does not result in clogging of solids at or near the center of the impeller, thereby producing a dead zone. Because the configuration of the chopper pump of the present invention avoids the development of a central dead zone or clogging of solids, and provides for flow of solids and fluid through the eye of the impeller, pump efficiencies are markedly improved.

16 Claims, 9 Drawing Sheets

PUMP IMPELLER AND CHOPPER PLATE FOR A CENTRIFUGAL PUMP

CROSS-REFERENCE TO RELATED APPLICATION

This application is a non-provisional application claiming priority to provisional patent application Ser. No. 60/482,977 filed Jun. 27, 2003.

BACKGROUND OF THE INVENTION

1. Field of the Invention

This invention relates to centrifugal pumps of the type commonly known as chopper pumps, which are configured to process solid waste materials such as medical waste, municipal waste and food-processing waste. Specifically, this invention relates to an impeller and chopper plate having a cutter bar structured for use in a chopper pump.

2. Description of Related Art

Various industries involve or require the processing of solid waste material into a form that can be disposed of in a suitable manner. Certain solid wastes containing or comprising, for example, plastics, metals, animal byproducts and other hard or stringy materials present a particular challenge to processing the material into a disposable form. Therefore, centrifugal pumps of the type known as chopper pumps are typically employed in processing such solid waste materials into a size that can be disposed of or processed further as needed.

Chopper pumps are typically characterized by having an impeller that is structured to contact a cutting element positioned adjacent the vanes of the impeller to exert a cutting or chopping action on the solid waste material entering the pump. A majority of the chopper pumps known in the industry further employ a booster impeller or chopper blade that also interacts with the cutting element positioned adjacent the vanes of the pump impeller to aid in chopping or cutting the waste material prior to entry of the material into the pump impeller. Examples of such pumps are disclosed in U.S. Pat. No. 3,973,866 to Vaughan, U.S. Pat. No. 4,840,384 to Dorsch and U.S. Pat. No. 6,190,121 to Hayward, et al.

When a booster or chopper blade is employed, the chopper blade is secured to the terminal end of the drive shaft and is rotated with the pump impeller. The chopper blade is spaced from the pump impeller by a stationary intake plate and the drive shaft extends through the center of the intake plate to engage the chopper blade. Similarly, a space is provided between the chopper blade and the intake plate.

The described configuration of known chopper pumps produces a central zone located at the eye of the pump impeller and about the hub of the chopper blade where solid material cannot be cut and fluid cannot be pumped, thereby reducing the flow efficiency and chopping efficiency of the pump. Moreover, stringy material can wrap around or become lodged about the hub of the chopper blade in many chopper pumps, thereby decreasing pump efficiency or potentially halting pumping operation altogether. Additionally, with chopping efficiencies reduced at the center or eye of the impeller, otherwise known as a "dead spot," cutting must take place solely near the outside diameter of the impeller.

Thus, it would be advantageous to provide a chopper pump having an impeller and associated chopper plate which are designed to avoid the problems encountered with conventional chopper pumps where material becomes trapped near the eye of the impeller, and a chopper pump which provides improved flow efficiencies.

BRIEF SUMMARY OF THE INVENTION

In accordance with the present invention, an impeller and associated chopper plate having a cutter bar are designed for use in a centrifugal pump of the chopper type to provide cutting action across the center axis of the pump at the impeller eye to avoid entrapment or clogging of solid material in a central zone as experienced in conventional chopper pumps. Further in accordance with the present invention, the impeller is designed to provide flow of fluid through the eye of the impeller to improve flow efficiencies.

A chopper pump of the present invention is structured with a chopper plate that is configured with a cutter bar that is positioned to interact with the impeller vanes of the pump to effect a chopping and/or cutting action on solids entrained in fluid entering the pump. More importantly, the chopper plate is structured with at least one cutter bar that extends across the radius of the opening of the chopper plate, thereby spanning a substantial portion of the radius of the pump impeller to improve chopping and cutting efficiencies.

The cutter bar is further structured to provide a "hubless" arrangement of the chopper plate and impeller to avoid the occurrence of a "dead spot" in the center of the impeller at the eye. By the term "hubless" is meant that the pump of the present invention does not have a centrally located axially extending element on the suction side (i.e., directed toward the pump inlet) of the impeller that connects to the cutter bar of, or to, the chopper plate, or which connects to and/or extends axially from the eye of the impeller as is known with conventional chopper pumps. Because the chopper pump of the present invention is essentially "hubless" as herein defined, cutting and chopping takes places across the entire length of the chopper bar, including at the eye of the impeller.

Furthermore, because the "hubless" arrangement eliminates the conventional obstructive elements at the center of the impeller or chopper plate on the suction side, there is no structure about which stringy solids can adhere or wrap to cause a dead zone in the center of the impeller pump. Consequently, solid materials are cut efficiently across the entire radius of the opening of the chopper plate and across a substantial portion of the radius of the impeller, and both solids and fluid are pumped through the eye of the impeller with greater efficiency than is known in prior art chopper pumps.

Because the cutter bar of the chopper plate extends along the radius of the opening of the chopper plate and spans a substantial portion of the radius of the impeller, the cutter bar is stronger and more durable than cutter bars of prior art chopper pumps. That is, in some known chopper pumps that employ cutter bars on a chopper or intake plate, the cutter bars extend from a position near the periphery of the chopper plate toward the center of the pump near the impeller eye, but end short of the center near the eye of the impeller. Consequently, the cutter bars can become damaged or broken off when encountering very hard solids.

The chopper pump of the present invention further includes an impeller that is configured to interact with the chopper plate and chopper bar to efficiently cut and chop solids entrained in the fluid. Specifically, the impeller is of an open eye configuration which eliminates any centrally or axially extending element that might become clogged with solid (usually stringy) debris, thereby causing a dead zone in the center of the impeller. Further, the open eye configuration of the impeller enables solids and fluid to flow through the eye of the impeller, thereby improving pump efficiencies as compared with conventional chopper pumps. The impeller of the present invention may be shroudless or have a shroud positioned on the drive side of the impeller.

The impeller of the present invention may further be structured with cutting elements positioned on the drive side of the impeller to cut and/or chop solid materials that move toward or infiltrate the drive side of the impeller. The cutting elements may be positioned at or near the periphery of the impeller, or at or near the central hub of the impeller where the impeller connects to the drive shaft, or in both locations. The impeller may also be configured with one or more expeller vanes positioned on the drive side of the impeller to move cut solids away from the central hub and drive shaft of the pump.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
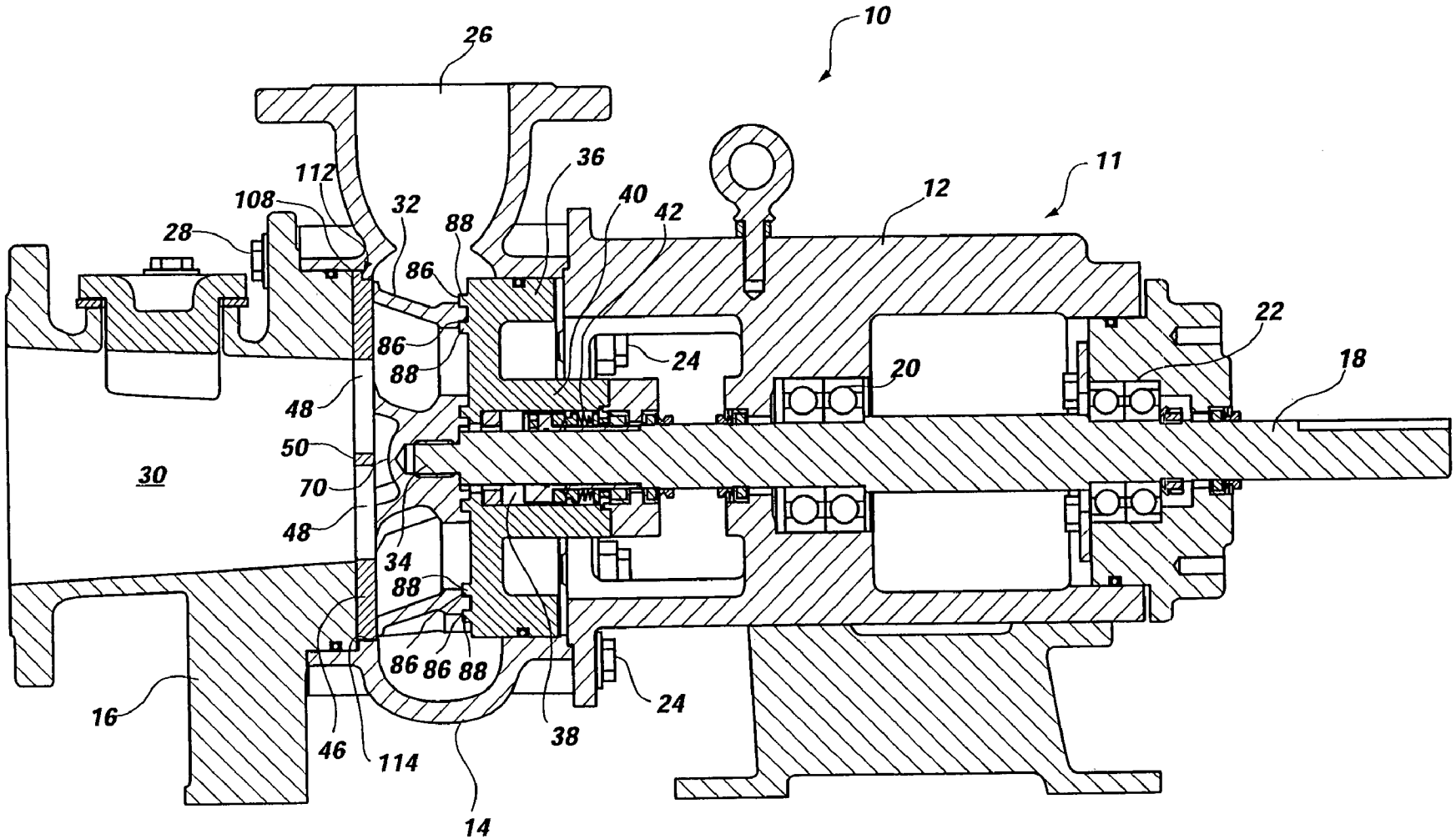
FIG. 1 is a view in longitudinal cross section of the a centrifugal pump of the present invention.

In accordance with the present invention, a centrifugal pump 10 of the chopper type is shown in FIG. 1. The chopper pump 10 generally comprises a pump casing 11 that houses the inner working elements of the pump 10 and may vary in configuration and structure. However, by way of example, the pump casing 10 illustrated in FIG. 1 includes a drive casing 12, a volute casing 14 and a suction casing 16. The drive casing 12 generally houses a drive shaft 18, which is supported by bearings 20, 22. The volute casing 14, which is secured to the drive casing by bolts 24, is structured with an outlet 26 for egress of processed fluid and solids from the pump 10. The suction casing 16, which is secured to the volute casing 14 by bolts 28, provides an inlet 30 through which fluid and solids are directed for processing by the pump 10.

The impeller 32 of the present invention is shown positioned within the volute casing 14 and is secured to the terminal end 34 of the drive shaft 18. In the particular pump embodiment illustrated in FIG. 1, a back plate 36 is located within the volute casing 14 and is positioned against the drive casing 12. The back plate 36 is structured with a central opening 38 through which the drive shaft 18 extends to secure the impeller 32 to the terminal end 34 of the drive shaft 18. In this particular embodiment, the back plate 36 is structured with an annular collar 40 that extends into the drive casing 12. The annular collar 40 further provides housing for a seal mechanism 42 that surrounds the drive shaft 18.

The impeller 32 is positioned adjacent the back plate 36. The impeller 32 is also positioned adjacent a chopper plate 46, which is secured in place between the volute casing 14 and the suction casing 16, as described more fully hereafter. The chopper plate 46 is structured with intake openings 48 through which fluid and entrained solids entering into the pump inlet 30 move toward the impeller 32. The chopper plate 46 is formed with a cutter bar 50 positioned to interact with the impeller 32, as described more fully hereafter.

Figure 2:
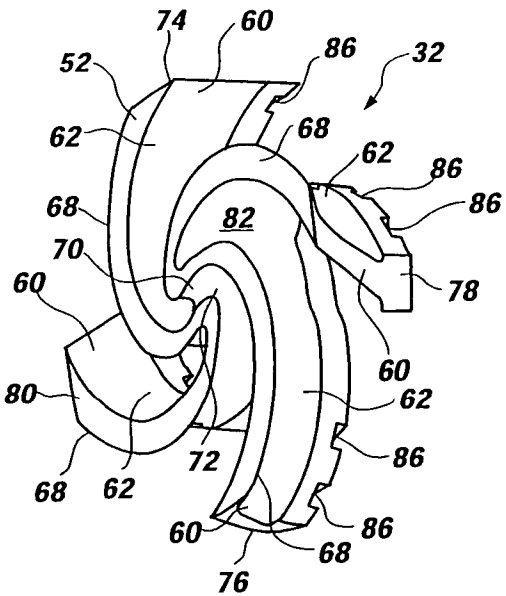
FIG. 2 is a perspective view of a first embodiment of an impeller used in the centrifugal pump of the present invention.
Figure 3:
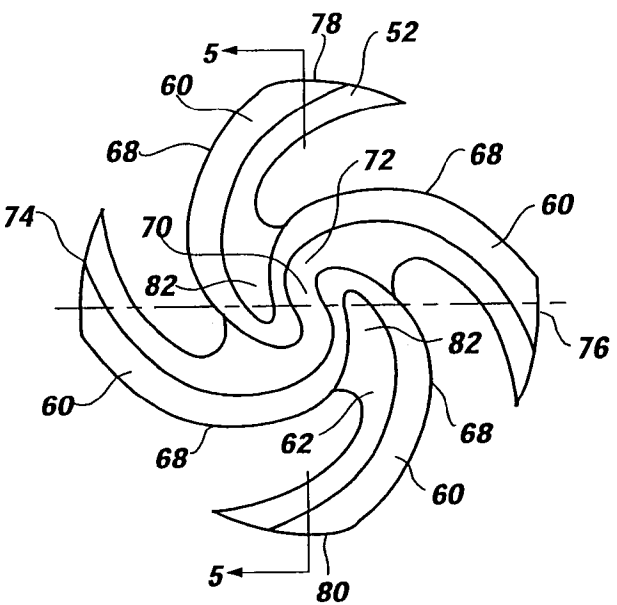
FIG. 3 is a view in elevation of the suction side of the impeller shown in FIG. 2.

FIGS. 2–5 illustrate a first embodiment of an impeller 32 of the present invention. FIG. 2 illustrates in a perspective view the suction side 52 of the impeller 32, or that side which is oriented toward the pump inlet 30. FIG. 3 illustrates the drive side 56 of the impeller 32. As seen from FIG. 3, the impeller 32 has a central hub 54, located on the drive side 56 of the impeller 32, which is configured with a central opening 58 sized to receive the terminal end 34 of the drive shaft 18. A plurality of vanes 60 extend out radially from the central hub 54. Four vanes 60 are illustrated, but the number of vanes may be greater or lesser in number than shown.

Each vane 60 is generally structured to extend radially outwardly from the central hub 54 in an arcuate orientation, thereby providing a leading surface 62 on each vane 60, best seen in FIG. 2. The leading surface 62 of each vane 60 contacts the solid materials in the fluid and moves the solids toward the outlet 26 of the pump 10. Each vane 60 also has, on the suction side 52 of the impeller 32, a cutting edge 68 which contacts the chopper plate 46, as described more fully below.

It can be seen from FIGS. 2 and 3 that the impeller 32 is particularly configured with an impeller eye 70 that is open by virtue of the configuration of the vanes 60. That is, a through channel 72 is formed between opposingly positioned vanes 74, 76 which provides for movement of fluid into and through the impeller eye 70, thereby improving flow efficiencies in the pump. The oppositely opposing vanes 78, 80 are structured with closed, or non-interconnecting, channels 82 located near the impeller eye 70 which further provide for movement of fluid into and through the impeller eye 70.

Figure 4:
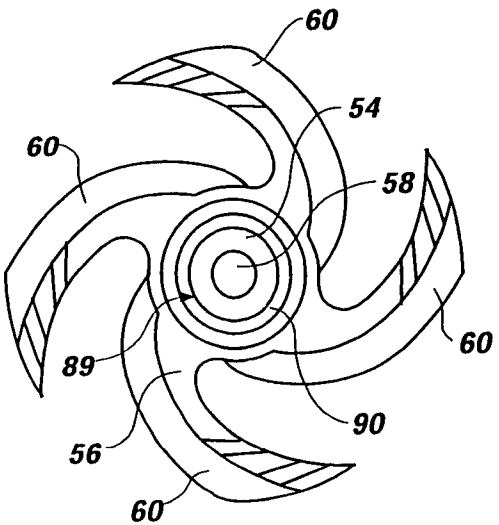
FIG. 4 is a view in elevation of the drive side of the impeller shown in FIG. 2.
Figure 5:
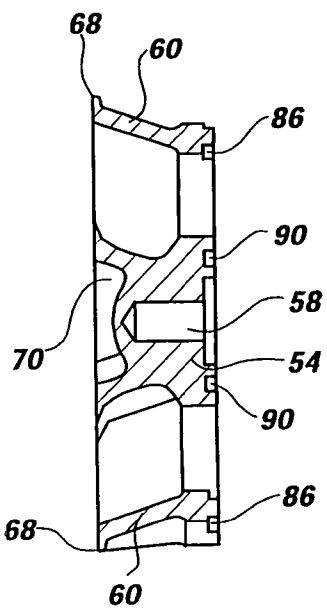
FIG. 5 is a view in cross section of the impeller taken at line 5—5 of FIG. 3.

The impeller 32 may further be configured with cutting elements positioned near the periphery of the impeller 32 to provide cutting action of solids that might infiltrate to the drive side 56 of the impeller 32. By way of example, a plurality of grooves 86 may be formed in the drive side 56 surface of each vane 60, as seen in FIGS. 2, 4, and 5. The grooves 86 are radially distanced from the central hub 54 and toward the outer periphery of the impeller 32. As best seen in FIG. 1, the grooves 86 are positioned to interact with cutter teeth 88 which are positioned on the back plate 36 and extend axially toward the impeller 32. Thus, as the impeller 32 rotates, the grooves 86 pass over the cutter teeth 88 thereby providing a cutting action at the periphery of the impeller 32, which aids in chopping the solids in the fluid. It is equally as suitable that axially extending cutting teeth be provided on the impeller 32 to interact with grooves formed on the back plate 36.

As best seen in FIGS. 1 and 4, the impeller 32 may also be structured with cutting elements 89 positioned in proximity to the central hub 54. By way of example, the impeller 32 may be formed with an annular groove 90 encircling the central opening 58 of the central hub 54. The annular groove 90 is positioned to receive an annular ring 92 (FIG. 1) which is positioned on the back plate 36 and extends axially outwardly toward the impeller 32. The interaction of the annular ring 92 traveling in the annular groove 90 provides further cutting action near the central hub 54 of the impeller 32 should solid material infiltrate past the outer periphery of the impeller 32. Other types or configurations of cutting elements 89 may be employed near the hub 54 to prevent solid material from accumulating about or clogging the central hub 54. Again, it may be equally suitable to provide an axially extending cutting element or tooth, or a plurality of teeth, that interact with a groove or grooves formed in the back plate 36.

Figure 6:
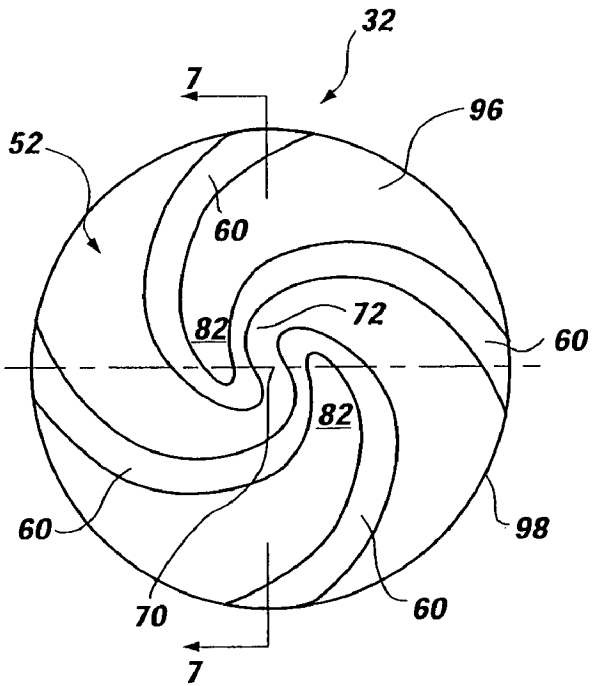
FIG. 6 is a view in elevation of the suction side of an alternative embodiment of an impeller used in the centrifugal pump of the present invention.
Figure 7:
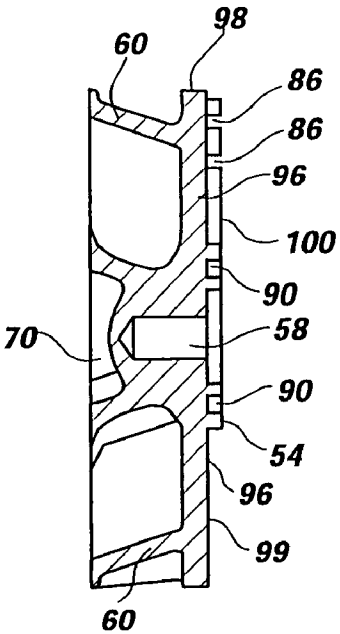
FIG. 7 is a view in cross section of the impeller embodiment shown in FIG. 6, taken at line 7—7.
Figure 8:
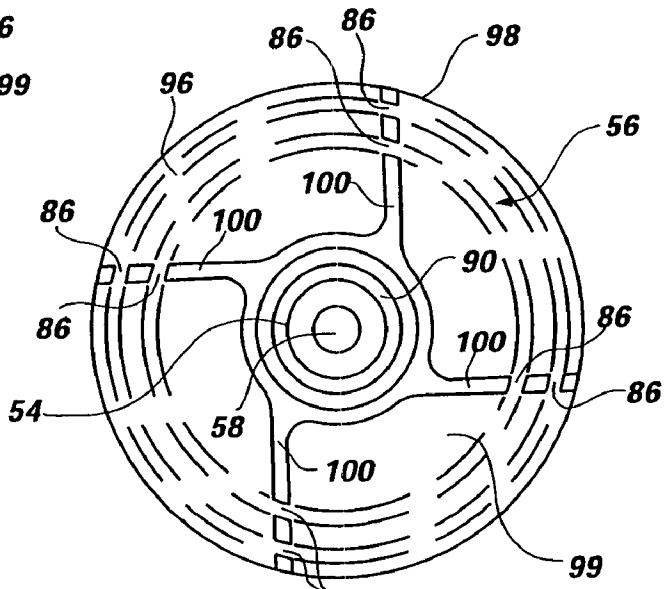
FIG. 8 is a view in elevation of the drive side of the impeller embodiment shown in FIG. 6.
Figure 12:
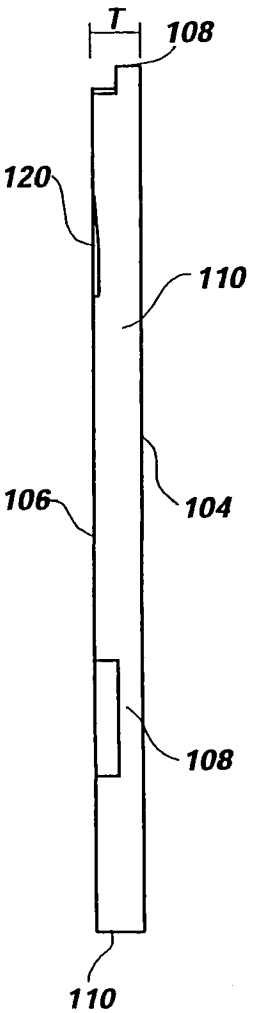
FIG. 12 is a side view in elevation of the chopper plate shown in FIG. 11, taken at line 12—12.

FIGS. 2–5 illustrate an embodiment of the impeller which is "shroudless," or sometimes referred to as an open impeller design. FIGS. 6, 7 and 8 illustrate an alternative embodiment of the impeller 32 of the present invention where the elements of the impeller 32 in this embodiment are the same as the previously described impeller embodiment of FIGS. 2–5, as denoted by use of like reference numerals to designate like parts. However, the alternative impeller embodiment of FIGS. 6–8 has a shroud 96 that is oriented toward the drive side of the pump 10. The shroud 96 generally comprises a plate-like backing to the impeller 32 and has an outer circumferential edge 98 which is sized to be received in the volute casing 14 of the pump 10.

Referring to FIGS. 7 and 8, it can be seen that in this embodiment, the central hub 54 of the impeller 32 extends axially outward from the rear surface 99 of the shroud 96 in a direction away from the impeller vanes 60. A plurality of expeller vanes 100 are shown to extend radially from at or near the central hub 54 and extend axially outward from the rear surface 99 of the shroud 96. Cutting elements may be provided, such as grooves 86 which interact with the cutting teeth 88 (FIG. 1) of the back plate 36. The grooves 86 as shown are formed along the length of each expeller vane 100 and toward the circumferential edge 98 of the shroud 96. The expeller vanes 100 operate to sling fluid and solid material away from the central hub 54 of the impeller and away from the seal mechanism 24 surrounding the drive shaft 18 in the area of the back plate 36. Similarly, cutting elements, such as annular groove 90 and annular ring 92, may also be provided in the alternative embodiment.

FIGS. 9–12 depict the chopper plate 46 of the present invention. The chopper plate 46 generally comprises a flattened ring having a defined thickness T. The chopper plate 46 has a first surface 104 oriented toward the suction side of the pump 10 and a second surface 106 oriented toward the impeller 32 of the pump. As shown more clearly in FIG. 1, the chopper plate 46 is positioned in the pump 10 between the suction casing 16 and the volute casing 14. The chopper plate 46 is located and retained in place against the volute casing 14 by means of locating tabs 108 which are formed along the outer circumferential edge 110 of the chopper plate 46 and extend radially outwardly therefrom. The locating tabs 108 are sized to register within corresponding grooves 112 formed along the circumferential inner edge 114 of the suction side of the volute casing 14 (FIG. 1).

The chopper plate 46 has a selected inner diameter 115 defined by an opening 116 through the chopper plate 46. The chopper plate 46 is further structured with a cutter bar 50 that spans the inner diameter 115 of the opening 116 through the chopper plate 46. The cutter bar 50 transects the opening 116 of the chopper plate 46 thereby forming intake openings 48 formed through the thickness T of the chopper plate 46. Fluid and solids flowing in through the inlet 30 of the pump enter through the intake openings 48 toward the impeller 32. It should be noted that although only a single cutter bar 50 is illustrated, the chopper plate 46 may be configured with two or more cutter bars that span the inner diameter 115 of the chopper plate 46 and may be oriented parallel to or at angles to each other.

Figure 10:
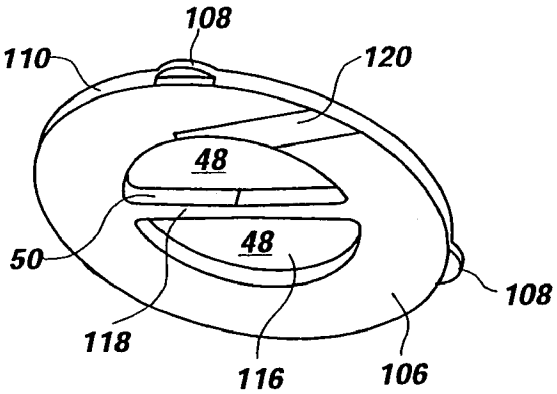
FIG. 10 is a perspective view of the drive side of a chopper plate of the present invention.
Figure 11:
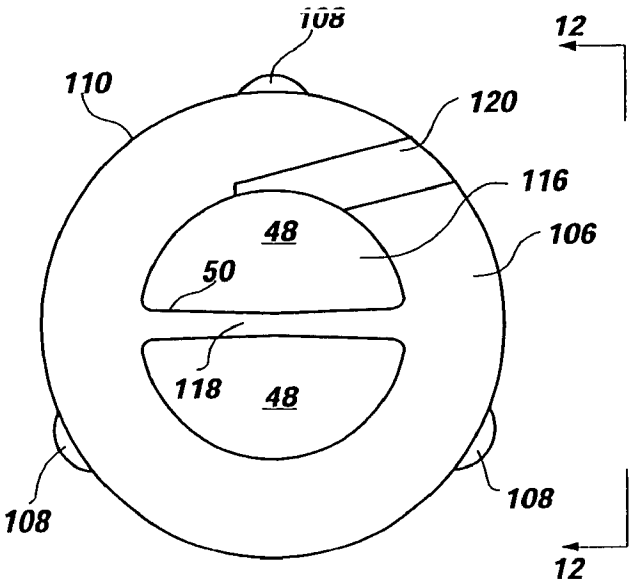
FIG. 11 is a view in elevation of the chopper plate as shown in FIG. 10.
Figure 9:
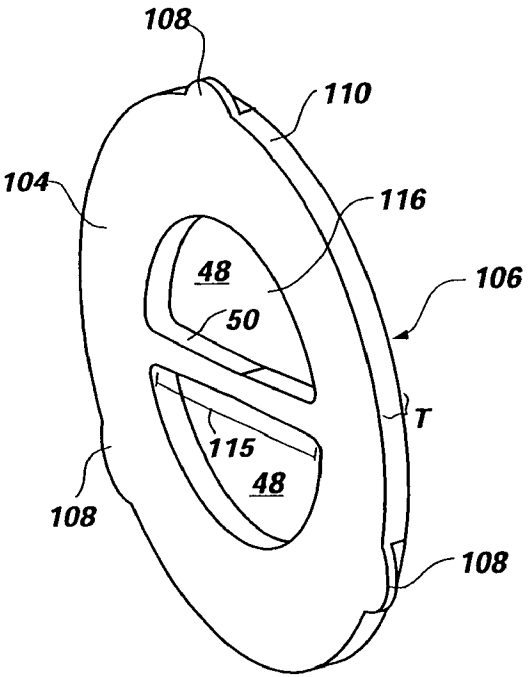
FIG. 9 is a perspective view of the suction side of a chopper plate of the present invention.

It can be seen from FIGS. 10 and 11 that the cutter bar 50 has an impact edge 118 which extends along the inner diameter 115 of the chopper plate 46. As the impeller 32 rotates, the impact edge 118 of cutter bar 50 comes in very close proximity to the cutting edge 68 of the vanes 60 of the impeller 32 to provide a chopping action on solids entering through the intake openings 48 from the pump inlet 30 toward the impeller 32.

The chopper plate 46 may also be configured with at least one oblique cutting element 120 positioned on the second side 106 of the chopper plate 46. Thus, as the impeller 32 rotates, the cutting edge 68 of the vanes 60 passes in close proximity to the oblique cutting element 120 thereby providing additional cutting action along the entire surface of the second side 106 of the chopper blade 46.

The impeller 32 and chopper plate 46 of the present invention are designed to provide improved solids processing and improved pump efficiencies over known chopper pump designs. This is accomplished by providing a cutter bar 50 that spans across the eye of the impeller and provides chopping at the eye of the impeller so that a dead zone does not result where solids are not chopped and where they might otherwise be caused to accumulate.

Additionally, the open eye design of the impeller improves flow of fluid and solids through the eye of the impeller and, again, prevents a dead zone from occurring at the center of the impeller. Flow efficiencies are further improved with the present impeller design since solids do not accumulate at the center of the impeller to cause flow impedance at the center of impeller, as occurs in prior art chopping pumps. The cutter bar of the present invention provides a stronger and improved implement for cutting at the intake of the pump because it spans the diameter of the intake.

Figure 13C:
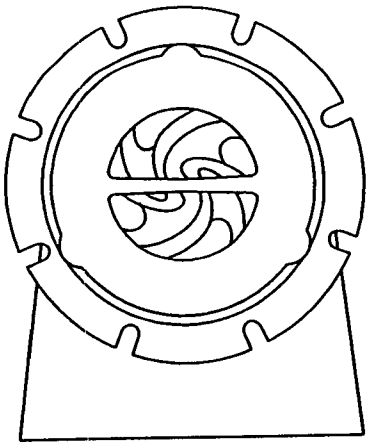
FIGS. 13A–13U are representational views, looking through the inlet of the pump toward the eye of the impeller, showing sequentially the movement of the impeller through one revolution (turning counterclockwise)
Figure 13F:
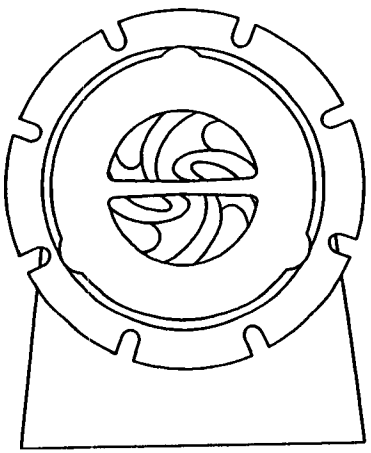
Figure 13B:
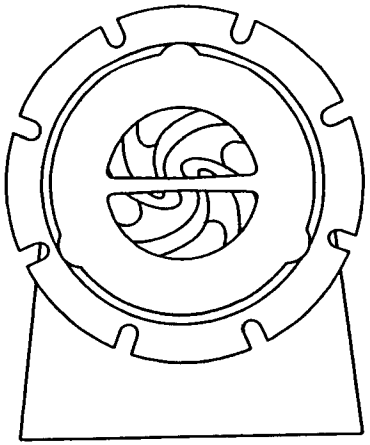
Figure 13E:
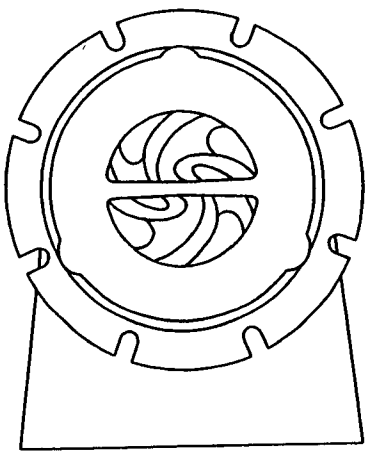
Figure 13A:
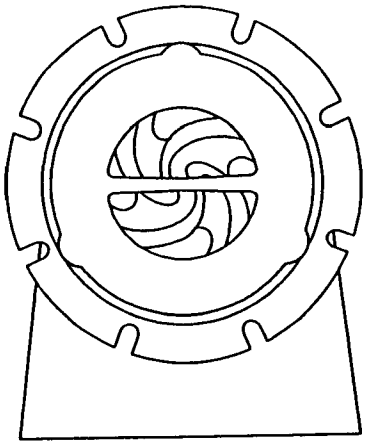
Figure 13D:
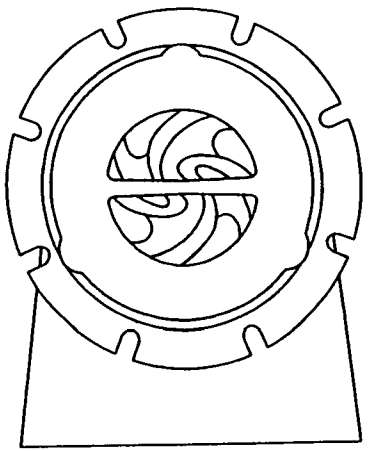
Figure 13I:
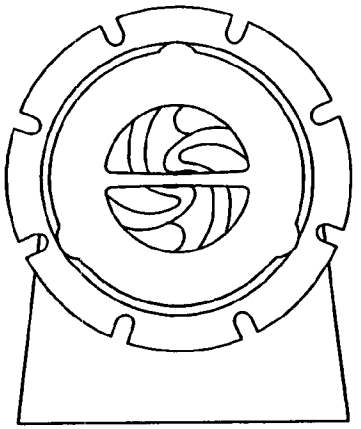
Figure 13L:
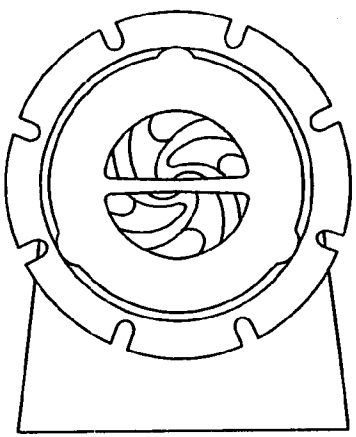
Figure 13H:
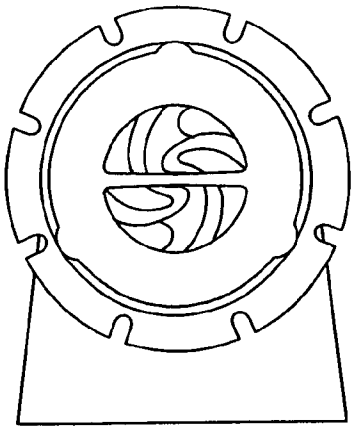
Figure 13K:
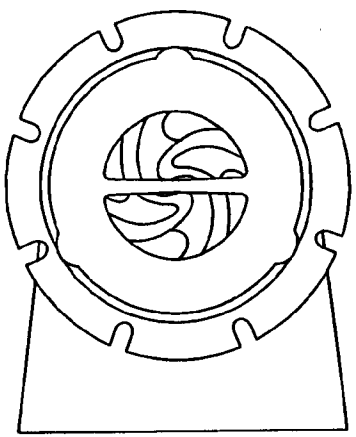
Figure 13G:
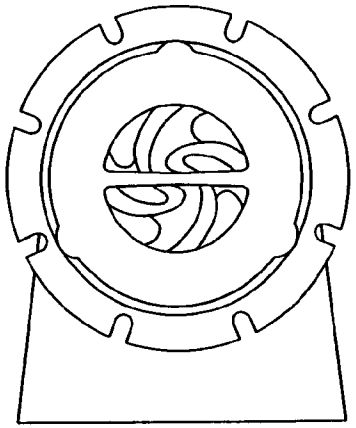
Figure 13J:
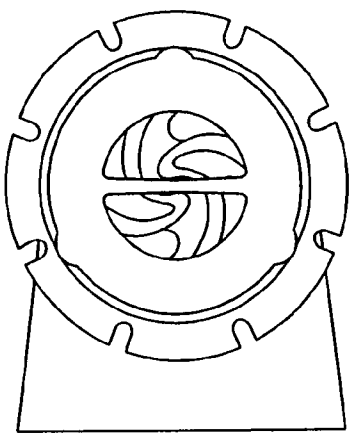
Figure 13O:
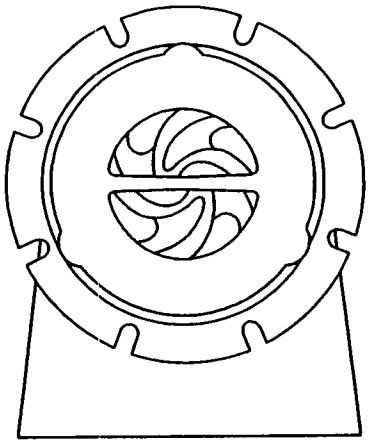
Figure 13N:
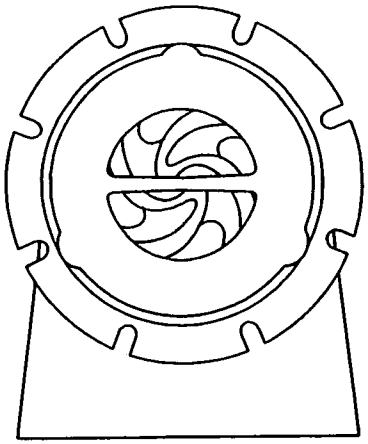
Figure 13M:
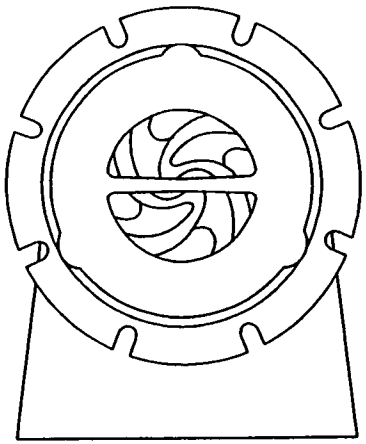
Figure 13R:
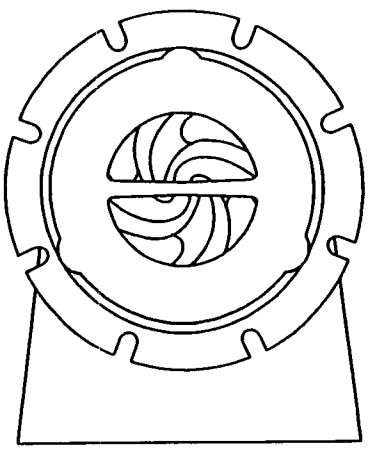
Figure 13Q:
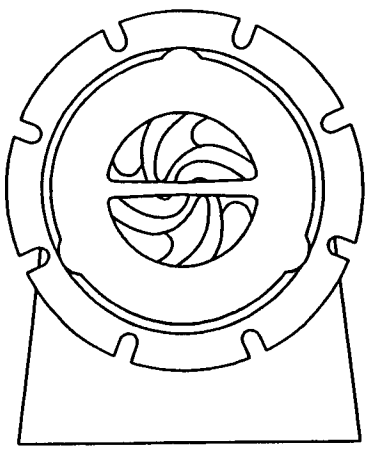
Figure 13P:
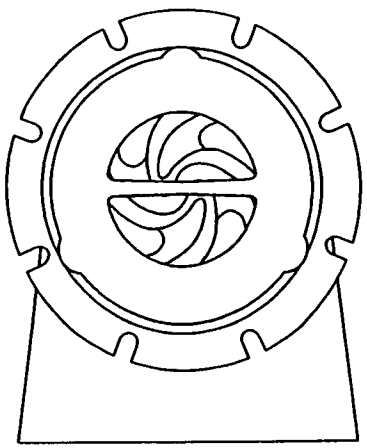
Figure 13U:
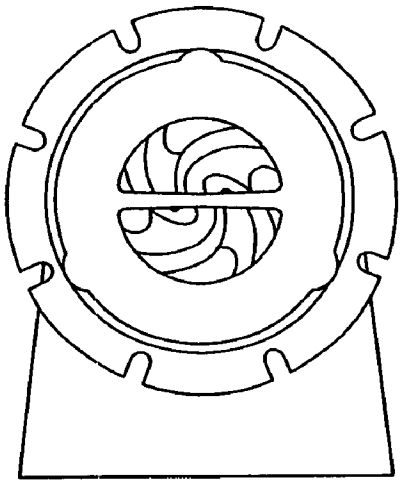
Figure 13T:
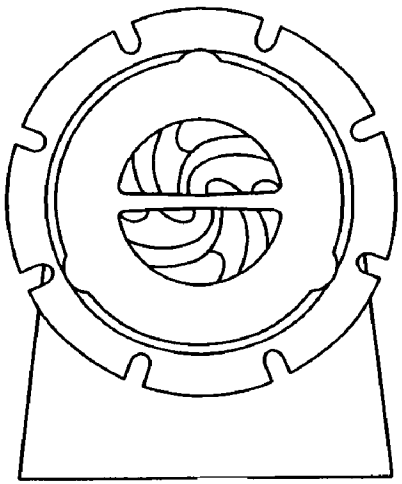
Figure 13S:
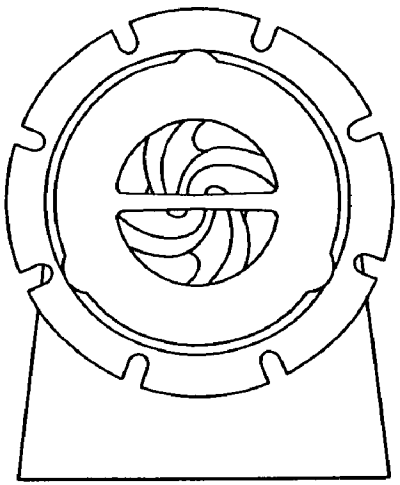
Figure 17:
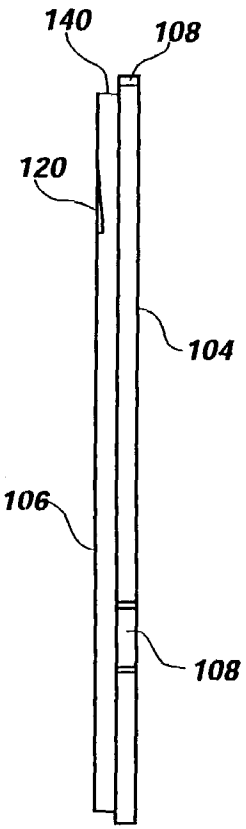
FIG. 17 is a side view in elevation of the chopper plate alternative embodiment shown in FIG. 16, taken at line 17—17.
Figure 15:
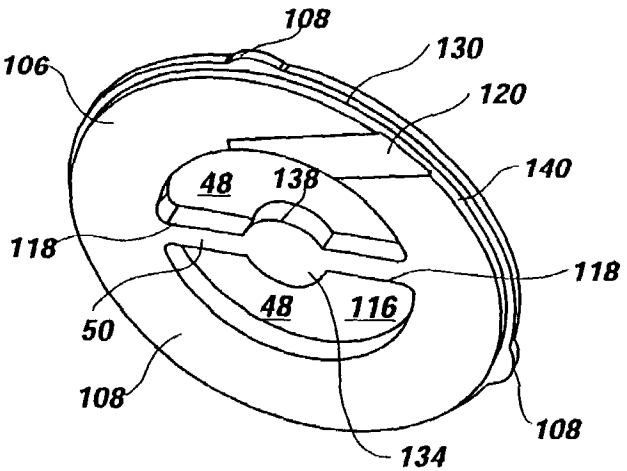
FIG. 15 is a perspective view of the drive side of the alternative embodiment of the chopper plate shown in FIG. 14.
Figure 16:
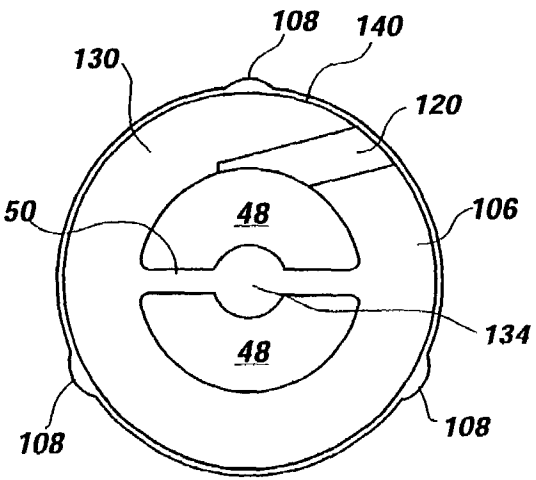
FIG. 16 is a view in elevation of the chopper plate alternative embodiment shown in FIG. 15.

FIGS. 13A through 13U depict sequentially the 360° rotation of the impeller of the present invention relative to the cutter bar to further illustrate how the eye of the impeller remains unobstructed during rotation to facilitate chopping of entrained solids and to improve flow through the center of the impeller.

Figure 14:
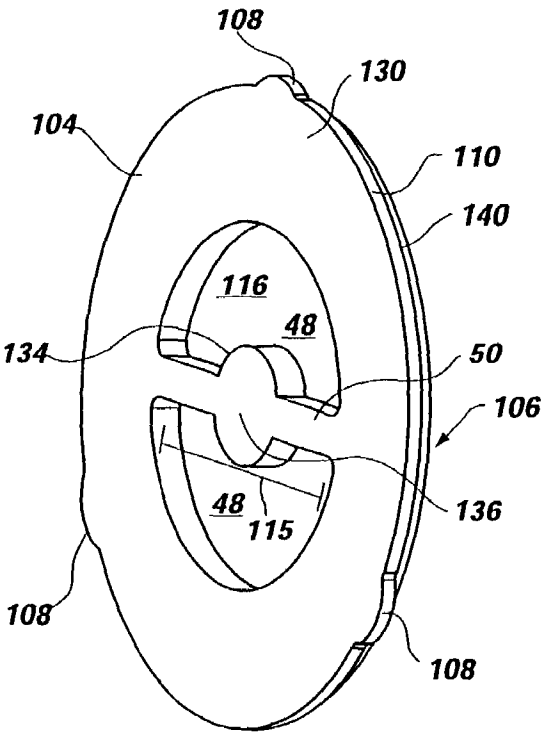
FIG. 14 is a perspective view of the suction side of an alternative embodiment of the chopper plate of the present invention.

FIGS. 14–17 depict an alternative embodiment of a chopper plate 130 of the present invention where like elements previously described are denoted with common reference numerals. FIG. 14 illustrates in a perspective view the first surface 104 of the chopper plate 130 of the alternative embodiment, or that side that is oriented toward the inlet of the pump. The chopper plate 130 is structured with a cutter bar 50 which spans the inner diameter 115 of the opening 116 through the chopper plate 46. However, in this embodiment, the cutter bar 50 is further configured with a radially extending element 134 that is located in the center of the cutter bar 50 and is positioned over the eye 70 (FIG. 2) of the impeller 32.

The radially extending element 134 provides a contact surface 136 that, in certain applications, aids in moving the entrained solids material toward portions of the impeller 32 where greater chopping or cutting action can be exerted on the solids material. Thus, by way of example only, if the influent being processed contains rag-like material, the rag-like material entering through the pump inlet contacts the radially extending element 134 and is directed radially outwardly for contact with the cutter bar 50 and impeller 32 in an area away from the eye of the impeller and chopping of the rag-like material is improved.

While the radially extending element 134 is illustrated in FIGS. 14–17 as being a generally circular disk shape, the peripheral shape and radial dimension may vary widely, and may be particularly selected with a peripheral shape and/or radial-circumferential dimension that is best suited to a particular type of entrained solid material being processed. Whatever the shape or dimension of the radially extending element 34, it is structured with an impact or cutting surface 138 that, like the impact edge 118 of the cutter bar 50, interacts with the cutting edge 68 of the vanes 60 of the impeller 32 to provide a chopping action on solids.

The alternative embodiment of the chopper plate 130 shown also differs in having an inwardly directed and circumferentially extending shoulder 134 that may be provided to help position and retain the chopper plate 130 with respect to the pump casing of the pump. The extending shoulder 138 may alternative be used in the embodiment of the chopper plate 46 illustrated in FIGS. 9–12.

The impeller and chopper plate of the present invention produce a chopper pump that has markedly improved chopping and pumping efficiencies over known chopper pump designs. The impeller and chopper plate of the present invention can be adapted to a variety of centrifugal pumps to provide an efficient chopper pump. The pump design illustrated and described herein is merely by way of example of the typical elements of a centrifugal pump and are not meant to limit the design elements or construction of the chopper pump to that which is illustrated herein. It will be apparent to those skilled in the art that certain design changes may be implemented in a centrifugal pump, such as casing configurations and drive shaft dimensions, to provide a chopper pump as set forth in the claims hereof.

What is claimed is:

1. A centrifugal pump of the chopper type, comprising:

a pump casing having an inlet and an outlet formed therein;

a drive shaft extending axially through said pump casing;

an impeller connected to said drive shaft and positioned within said pump casing, said impeller having a plurality of vanes and being formed with a central eye oriented toward said inlet; and a chopper plate positioned between said inlet of said pump casing and said impeller, said chopper plate having an inner diameter defined by an opening in said chopper plate and being formed with a cutter bar that extends across said inner diameter to interact with said impeller and provide cutting action between said cutter bar and said impeller at said central eye of said impeller.

2. The centrifugal pump of claim 1 wherein said central eye of said impeller is an open eye defined by at least one channel extending across the central eye of said impeller.

3. The centrifugal pump of claim 2 wherein said impeller is further structured with non-connecting channels radiating from said central eye and located between said plurality of vanes.

4. The centrifugal pump of claim 2 wherein said impeller further comprises a drive side oriented away from said chopper plate and comprises a periphery, and further wherein said impeller is structured with cutting elements positioned on said drive side of said impeller in proximity to said periphery.

5. The centrifugal pump of claim 4 wherein said impeller further comprises a central hub located on said drive side, said central hub being configured to attach to said drive shaft, and further wherein said impeller is structured with cutting elements positioned on said drive side in proximity to said central hub.

6. The centrifugal pump of claim 2 wherein said impeller further comprises a drive side oriented away from said chopper plate and has a central hub located on said drive side structured to attach to said drive shaft, and further wherein said impeller is structured with cutting elements positioned on said drive side in proximity to said central hub.

7. The centrifugal pump of claim 1 wherein said impeller further comprises a shroud spaced from said chopper plate, said shroud having a rear surface oriented away from said chopper plate and having a defined circumferential edge.

8. The centrifugal pump of claim 7 wherein said central eye of said impeller is an open eye defined by at least one channel extending across the central eye of said impeller.

9. The centrifugal pump of claim 8 wherein said impeller is further structured with non-connecting channels radiating from said central eye and located between said plurality of vanes.

10. The centrifugal pump of claim 7 wherein said impeller further comprises cutting elements positioned on said rear surface of said shroud in proximity to said circumferential edge.

11. The centrifugal pump of claim 10 wherein said impeller further comprises a central hub located proximate said rear surface of said shroud and structured for attachment to said drive shaft, and further wherein said impeller comprises cutting elements positioned on said rear surface of said shroud in proximity to said central hub.

12. The centrifugal pump of claim 7 wherein said impeller further comprises a central hub located proximate said rear surface of said shroud and structured for attachment to said drive shaft, and further wherein said impeller comprises cutting elements positioned on said rear surface in proximity to said central hub.

13. The centrifugal pump of claim 7 wherein said impeller further comprises at least one expeller vane located on said rear surface of said shroud.

14. The centrifugal pump of claim 13 wherein said impeller further comprises cutting elements positioned on said rear surface of said shroud.

15. The centrifugal pump of claim 1 further comprising a plurality of cutter bars extending across said inner diameter.

16. The centrifugal pump of claim 1 wherein said chopper plate is further configured with a radially extending element positioned on said cutter bar.

* * * * *